US011192226B2

(12) United States Patent
Keister et al.

(10) Patent No.: US 11,192,226 B2
(45) Date of Patent: Dec. 7, 2021

(54) FASTENER CARRIER WITH DEPTH LIMITER

(71) Applicants: Michael Keister, Marne, MI (US); Richard A Keister, Whitehall, MI (US)

(72) Inventors: Michael Keister, Marne, MI (US); Richard A Keister, Whitehall, MI (US)

(73) Assignee: Chicago Display Marketing Company, River Grove, IL (US)

( * ) Notice: Subject to any disclaimer, the term of this patent is extended or adjusted under 35 U.S.C. 154(b) by 203 days.

(21) Appl. No.: 16/051,174

(22) Filed: Jul. 31, 2018

(65) Prior Publication Data

US 2020/0039047 A1 Feb. 6, 2020

(51) Int. Cl.
*B25C 5/15* (2006.01)
*B25C 5/06* (2006.01)

(52) U.S. Cl.
CPC . *B25C 5/15* (2013.01); *B25C 5/06* (2013.01)

(58) Field of Classification Search
CPC .... B25C 5/15; B25C 5/06; B25C 5/10; B25C 5/11; B25C 5/13
USPC ..... 227/131
See application file for complete search history.

(56) References Cited

U.S. PATENT DOCUMENTS 4,087,035 A 5/1978 Harmon
4,380,312 A 4/1983 Landrus
4,821,937 A * 4/1989 Rafferty ..... B25C 1/008 227/142
5,074,453 A * 12/1991 Tachihara ..... B25C 1/043 227/130

(Continued)

FOREIGN PATENT DOCUMENTS

AU 2010100096 B4 3/2010
GB 776075 6/1957

OTHER PUBLICATIONS

Arrow Fastener T75 Wire and Cable Gun, fits up to 1/2-Inch Wires. <www.amazon.com>. Date: 2018.

(Continued)

*Primary Examiner* — Thanh K Truong
*Assistant Examiner* — Scott A Howell
(74) *Attorney, Agent, or Firm* — Jansson Munger McKinley & Kirby Ltd.

(57) ABSTRACT

A carrier with a fastener depth limiter. The carrier may be used to drive fasteners of a staple type. Carriers may include a fastener holder and a fastener depth limiter securable to the holder. The holder may include an axial body with distal and proximal ends, a fastener-receiving opening in the distal end normal to the axis, and an anvil-receiving opening in which an anvil repeatedly strikes a fastener held by the holder as the holder retracts during fastener driving. The fastener depth limiter may be a collar and the collar may be axially adjustable along the holder to enable user selection of the depth limitation. A workpiece-contacting distal end of a collar-type depth limiter may be spaced axially outward from the distal end of the holder a distance approximately the same as a thickness dimension of the fastener, which may be the thickness dimension of the crown of a staple-type fastener. The carrier enables consistent driving of each and every fastener relative to a cable or other workpiece thereby providing securement without damage that could be caused by excessive contact with the crown.

25 Claims, 10 Drawing Sheets

(56) References Cited

U.S. PATENT DOCUMENTS 5,263,626 A 11/1993 Howard et al.
5,884,829 A 3/1999 Wingert
6,481,612 B1 11/2002 Mangone, Jr.
6,585,142 B1 * 7/2003 Chen ..... B25C 1/04 227/113
6,695,192 B1 * 2/2004 Kwok ..... B25C 1/008 227/107
6,824,036 B2 * 11/2004 Walter ..... E04F 21/1855 227/119
6,848,607 B2 2/2005 Boswinkel et al.
7,066,371 B2 6/2006 Villela et al.
7,299,961 B2 * 11/2007 Stavig, Jr. ..... B21J 15/02 227/107
7,316,342 B2 * 1/2008 Chen ..... B25C 1/008 227/107
7,318,546 B2 * 1/2008 Segura ..... B25C 1/008 227/142
7,341,172 B2 3/2008 Moore et al.
7,513,404 B2 * 4/2009 Shkolnikov ..... B25C 1/008 227/130
8,052,359 B2 * 11/2011 Wirth, Jr. ..... B23B 49/005 408/191
8,186,554 B2 5/2012 Abla
8,757,464 B2 6/2014 Stratton
8,876,444 B1 * 11/2014 Chanturidze ..... B23B 49/005 408/191
10,307,903 B2 * 6/2019 Reed ..... E04F 21/1855
2003/0041704 A1 * 3/2003 Pelt ..... B25B 21/02 81/466
2007/0163397 A1 7/2007 Bader et al.
2007/0215668 A1 * 9/2007 Tabacco ..... B25C 7/00 227/107
2007/0278276 A1 * 12/2007 Wen ..... B25C 1/00 227/130
2009/0166394 A1 * 7/2009 Gyorkos ..... B25C 1/04 227/142
2011/0297728 A1 * 12/2011 Liang ..... B25C 7/00 227/142
2014/0276907 A1 * 9/2014 Nering ..... A61B 17/32002 606/110
2015/0272649 A1 10/2015 Lewis et al.
2019/0111553 A1 * 4/2019 Wannaquot ..... B25C 7/00
2020/0262044 A1 * 8/2020 Ferris ..... B25C 5/1648

OTHER PUBLICATIONS

Bostitch PN100 Industrial High Speed Impact Nailer Operation and Maintenance Manual. Bostitch Stanley Fastening Systems L.P. 120914REVC. Date: Oct. 2005.
Bostitch PN100 Industrial High Speed Impact Nailer Parts Diagram and List. Bostitch Stanley Fastening Systems L.P. IP11381-1 REVC Date: 2005.
Central Pneumatic Air Mini Hand Nailer, Model 90193 Assembly and Operating Instructions. Harbor Freight Tools. Date: 2003.
Hitachi Power Tools Bulk Nailer Model NH 90AB Parts Diagram and List. Hitachi Koki USA Ltd. Date: 2016.
Hitachi Power Tools Model NH 90AB Instruction and Safety Manual. Hitachi Koki Co., Ltd. Date: 2016.
Milwaukee M12 Palm Nailer Cat. No. 2458-20 Operator's Manual. Milwaukee Electric Tool Corporation. Date: 2012.
Milwaukee M12 Palm Nailer Cat. No. 2458-20 Service Parts List. Milwaukee Electric Tool Corporation. Date: Jul. 2013.
Porter-Cable PN650 Palm Nailer Kit. <www.amazon.com>. Date: 2018.
Senco PC0781 Hand Nailer Parts Reference Guide. Senco Products, Inc. Date: Nov. 15, 2000.
Senco PC0781 Hand Nailer Operating Instructions. Senco Products, Inc. Date: Dec. 22, 2000.
Senco Staple Chart. Senco Products, Inc. Date: undated.
Excerpt from W. W. Cross Industries, Inc. product catalog "Staples for Professionals". W. W Cross Industries, Inc. Date: undated.
International Search Report and Written Opinion for PCT/US2019/033712. dated Aug. 8, 2019. 12 pages.

* cited by examiner

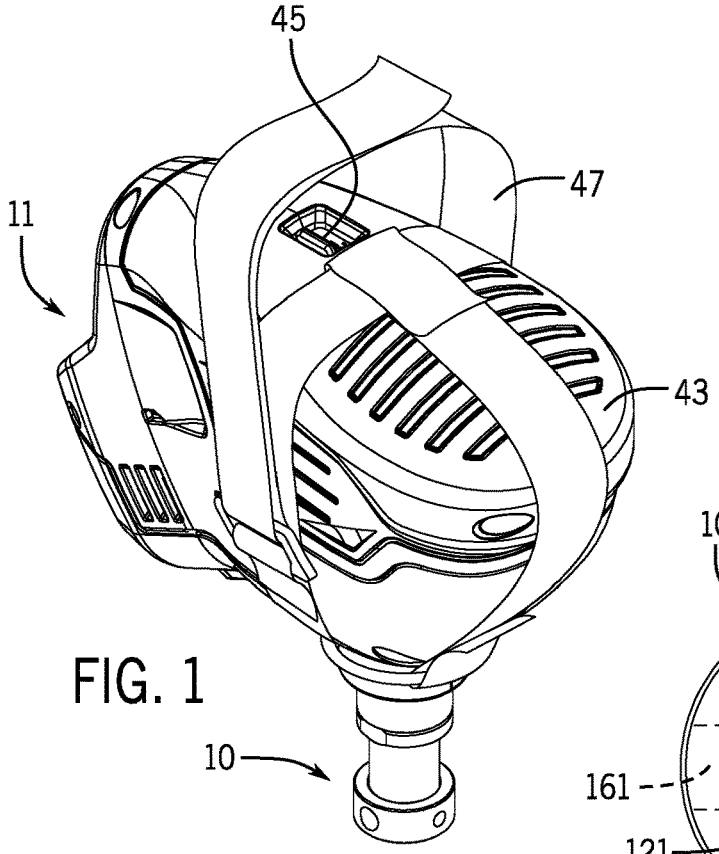
FIG. 1
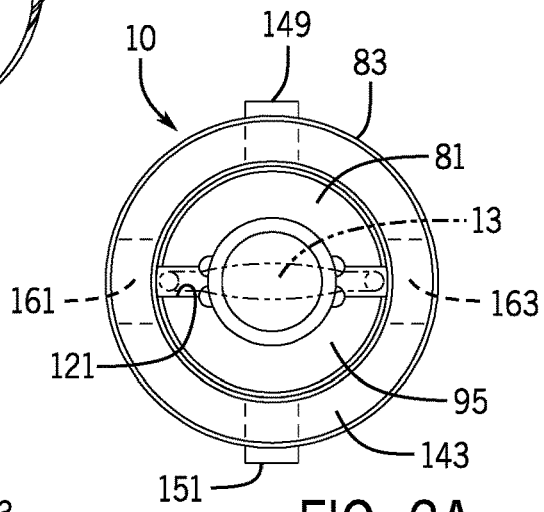
FIG. 2A
FIG. 2
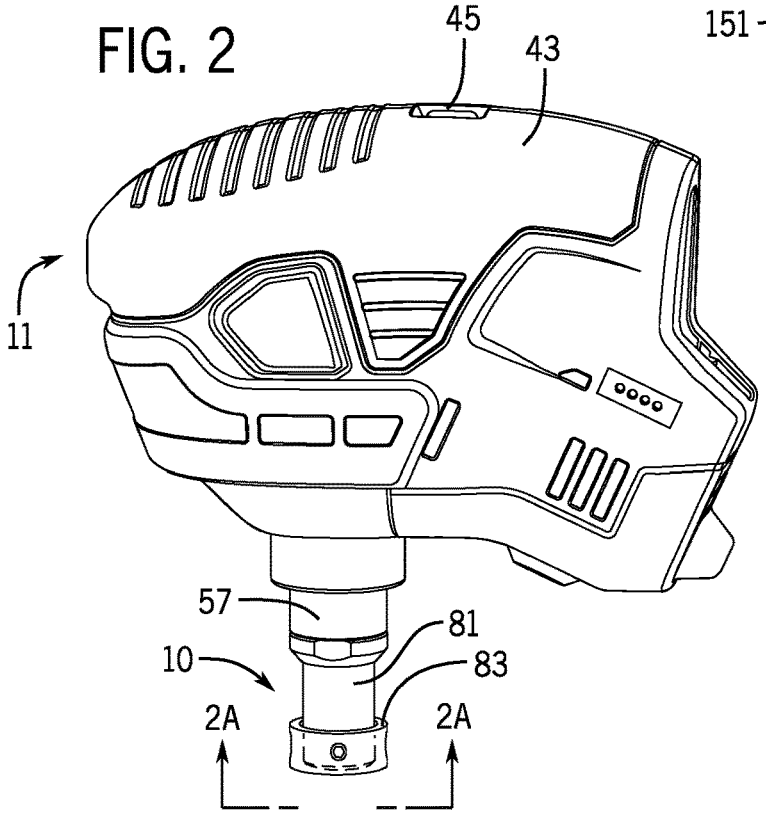

FIG. 3
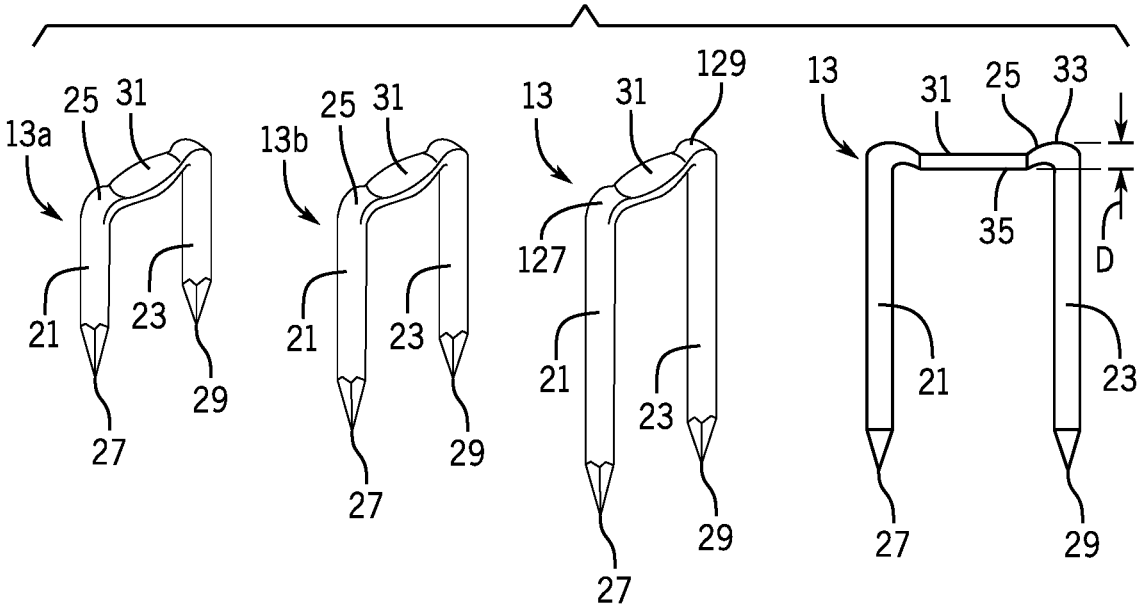
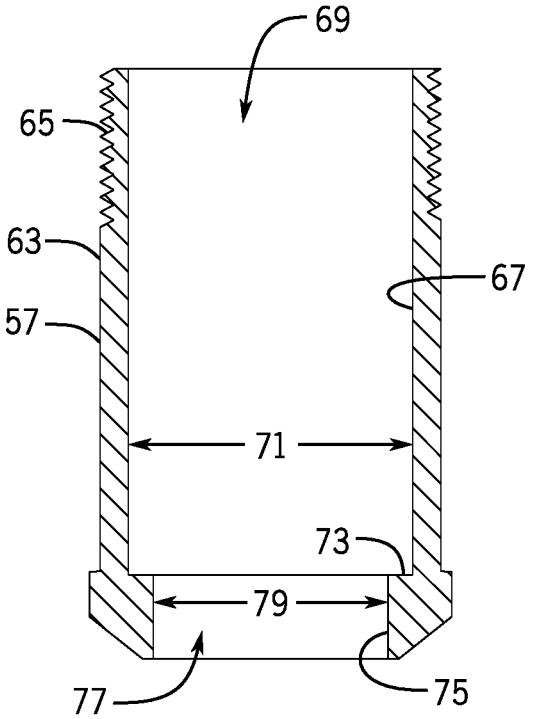
FIG. 8

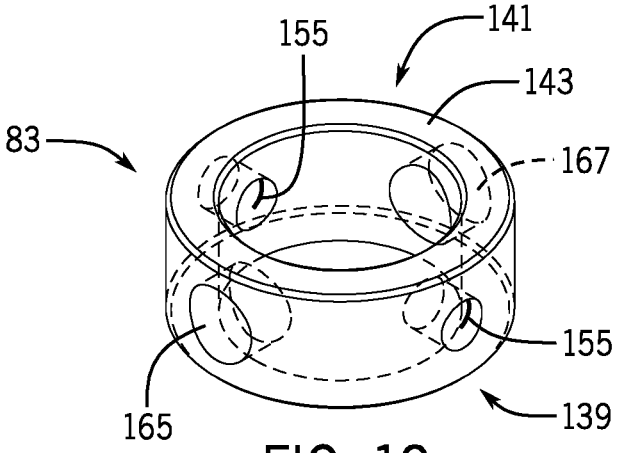
FIG. 19
FIG. 20
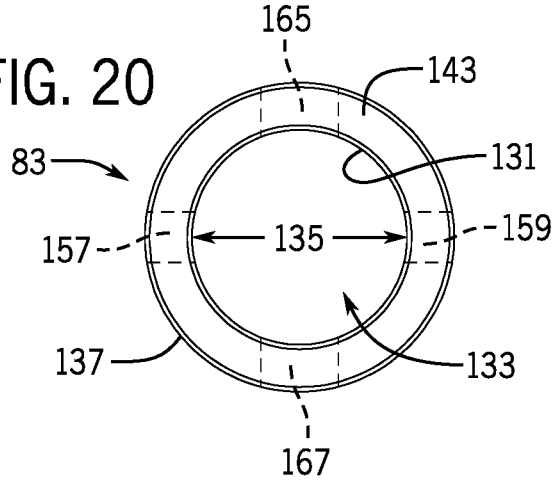
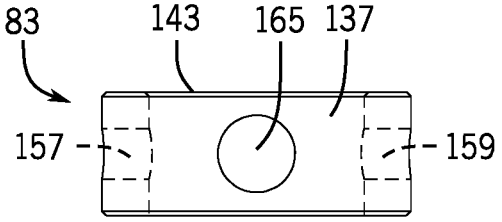
FIG. 21
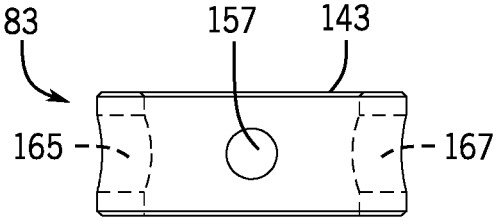
FIG. 22

FASTENER CARRIER WITH DEPTH LIMITER

FIELD

The invention relates to fastener-driving tools, and more particularly, to carriers usable with a fastener-driving tool for driving fasteners to a consistent and repeatable depth.

BACKGROUND

During commercial and residential building construction, remodeling, and repair, and in other settings, it is frequently necessary to secure one component to another. For example, electricians are regularly called upon to install electrical cable within a building or other structure. The cable to be installed is frequently a flexible, insulated type of cable referred to as thermoplastic-sheathed cable (TPS). The insulator providing the protective sheath is typically made of polyvinyl chloride (PVC) material and the insulator surrounds one or more conductors. Cable of this type is frequently sold under the tradename Romex.

Frequently, TPS-type cable is installed without being contained within a rigid conduit. Instead, the flexible TPS cable must be secured directly to surfaces along which the cable passes. These surface can include vertical wall studs, horizontal floor joists, and just about any other type of surface and thing. The surface may be of any material into which a fastener may be driven such as wood, concrete, and polymeric materials.

Typically, the electrician uses a fastener to secure the TPS-type cable to the surface or thing. The fastener is frequently, but not always, a U-shaped fastener known as a cable staple. The U-shaped staple may consist of a pair of legs and a crown connecting the legs. The crown may include a "flat" or flattened section between the legs which is a widened portion of the crown ideal for striking with a hammer. There are many different types of staples for use in securing cable which include nob staples, service cable staples, standard cable staples, long leg nob staples, insulated nob staples, insulated staples, and super staple cable staples. The fastener used to secure the TPS-type cable may be selected to go around the cable to thereby avoid cutting or tearing of the insulator and damaging the cable. Cable staples are ideal for securing TPS-type cable because the staple size can be selected so that the legs straddle the cable enabling the legs and crown to hold the cable in place against the surface without damage to or penetration of the insulator.

As can be appreciated, a fastener-driving tool of some sort must be used to drive the fastener into the surface. The tool is oftentimes a hand-held conventional hammer. A hammer, however, is disadvantageous because that type of tool is inefficient given that hundreds, or possibly thousands, of fasteners must be driven during the course of any given construction project. And, there may be insufficient freedom to swing a hammer because of obstructions. Hammers can also damage the cable.

Fastener-driving tools, such as staple guns and the like, can be used to automatically drive a fastener to secure a workpiece onto a surface. However, an important disadvantage of these types of tools is that a significant amount of force may be applied by the fastener-driving tool to drive the fastener. The high force can be such that the fastener may be driven through or into the TPS-type cable insulator, tearing or cutting the insulator and conductors, and potentially creating a short circuit or even a fire hazard.

Problems such as those described above are encountered by other trades, such as roofers and carpenters, who need to efficiently secure one thing to another without the fastener causing damage to the thing being secured. For instance, roofers have a need to secure roofing felt and shingle material to a roof deck and carpenters need to secure all manner of things to other surfaces, all without damaging the thing to be secured by excessive driving of the fastener.

It would be an advance in the art to provide a tool for use with a fastener-driving tool which would enable driving of a fastener, such as a generally U-shaped staple, without damaging the thing to be secured, which would enable driving of the fastener to a consistent and repeatable depth particularly with respect to a cable or other thing being secured by the fastener, which would enable rapid and efficient fastener driving, which would enable fastener driving in confined places, which could be used with many different types of fastener drivers, which would be robust and capable of heavy-duty use, and which would make the process of fastener driving better, thereby providing opportunities to improve the efficiency of electrical, construction, and other types of work.

SUMMARY

Embodiments of a fastener carrier with a depth limiter are disclosed herein. Carriers of the types described herein may be usable with a fastener-driving tool for rapid driving of fasteners into a surface without damage to the article or other workpiece being secured by the fastener. In embodiments, the carrier may be configured to hold a staple (i.e., a generally U-shaped fastener) during driving and the depth limiter may consistently and repeatably control the depth to which the staple is driven relative to the article or other workpiece to thereby secure such article or other workpiece in a non-damaging manner. Embodiments of a carrier may be utilized, for example, to quickly and efficiently drive staples used to hold TPS-type electrical cable against a stud, joist, or other surface.

In embodiments, a carrier may comprise a fastener holder and a fastener depth limiter. The fastener holder may hold the fastener throughout the fastener driving process while the depth limiter may limit the depth to which the fastener can be driven relative to the cable, article or other workpiece being secured. For staple-type fasteners, the crown of each staple will have the same spatial relationship with the cable, article or other workpiece being secured even though the legs of the staple may be driven a greater or a lesser distance into the stud, joist, or other surface.

An example of a fastener holder may include an elongate body, an outer surface, and distal and proximal ends defining an axis therebetween. A fastener-receiving opening may be provided in the distal end normal to the axis. An internal anvil-receiving opening may extend from the proximal end of the body into the fastener-receiving opening and to the distal end to allow an anvil of the fastener-driving tool to strike a staple-type fastener in the fastener-receiving opening. Such anvil-receiving opening may be coaxial with the axis.

In embodiments, the fastener-receiving opening may be a slot to hold a staple-type fastener. The slot may extend entirely across the body defining slot openings in the body distal end and body outer surface. In embodiments in which the body has a cylindrical shape, the slot may extend across a diameter of the body. The slot may have a width dimension and the width may be approximately the same as a thickness dimension of the staple or other fastener. A magnet may be provided to hold a magnetically-attractive fastener in the slot.

In embodiments, the fastener holder may be secured for axial back-and-forth movement with respect to the fastener-driving tool. The holder may be secured to the fastener-driving tool by a sleeve and may be biased outward from the fastener-driving tool. Driving of the fastener may occur as the carrier is pushed toward and against the cable, article, or other workpiece to be secured causing the holder to axially retract against the biasing force enabling an anvil of the driver to repeatedly provide fastener driving strokes to the crown of the staple. The body of the holder may have a length selected so that the maximum stroke of the anvil is to the distal end of the body when the holder is fully retracted.

The fastener depth limiter may be securable to the body of the holder at one of a plurality of axial positions in certain embodiments. The fastener depth limiter may be of a collar-type in certain embodiments and such a collar may be around the body of the holder. If the holder is of a cylindrical shape, the collar may be of an annular-type to provide an annular collar. The inside diameter of such an annular collar may have an inside diameter sized to allow the annular collar to slide axially over the body outer surface and a stop member, such as one or more set screw, may be used to hold the annular collar in place on the body.

The depth limiter may have a workpiece-contacting distal end which may be spaced axially outward from the holder distal end. In embodiments, the distal end of the holder body and the distal end of the collar may be characterized as faces and spacing of the collar distal end face outward from the body distal end face determines the limit of the depth of the fastener driving. The faces may be planar. The spacing of the faces may be an amount equal to or greater than a thickness dimension of the crown of the staple and such spacing limits the depth of the fastener driving relative to the article, cable, or other workpiece being secured.

In the embodiments and during or before fastener driving, the face of the collar extending past the face of the holder will eventually contact the cable, article or other workpiece being secured. In such embodiments and because of the length of the holder body, the maximum stroke of the anvil may be only to the distal end of the fully retracted body. Therefore, spacing of the collar face outward from the face of the holder limits the depth to which the fastener can be driven relative to the workpiece or other thing being secured. If the spacing of the faces is selected by the user to be an amount equal to or greater than a thickness dimension of the crown of the staple, then the staple will always be driven snugly against the cable or other workpiece and yet will not tear or cut the cable insulator or otherwise damage the article or other workpiece being secured.

Other aspects and examples of the fastener carrier with a depth limiter are described in the disclosure which follows.

BRIEF DESCRIPTION OF THE DRAWINGS

Exemplary fastener carriers including a depth limiter may be understood by reference to the following description taken in conjunction with the accompanying drawings, in which like reference numerals identify like elements throughout the different views. The drawings are not necessarily to scale, emphasis instead being placed upon illustrating the principles of the invention. The drawings depict only embodiments of the invention and are not therefore to be considered as limiting the scope of the invention. In the accompanying drawings:

FIG. 1 is a perspective view of a fastener-driving tool together with a fastener carrier according to the invention;

FIG. 2 is a side elevation view of the fastener-driving tool and carrier of FIG. 1;

FIG. 2A is a plan view of the distal end of the carrier of FIG. 1 taken in the direction of view 2A-2A of FIG. 2;

FIG. 3 illustrates three different staple-type fasteners;

FIG. 8 is a section view of the sleeve of FIG. 3 taken along section 8-8 of FIG. 6;

FIG. 19 is a perspective view of a carrier collar showing certain internal features in broken line;

FIG. 20 is a distal end plan view of the collar of FIG. 19;

FIG. 21 is a side elevation view of the collar of FIG. 19 showing certain internal features in broken line; and FIG. 22 is a further side elevation view of the collar of FIG. 19 showing certain internal features in broken line.

DETAILED DESCRIPTION

Figure 4A:
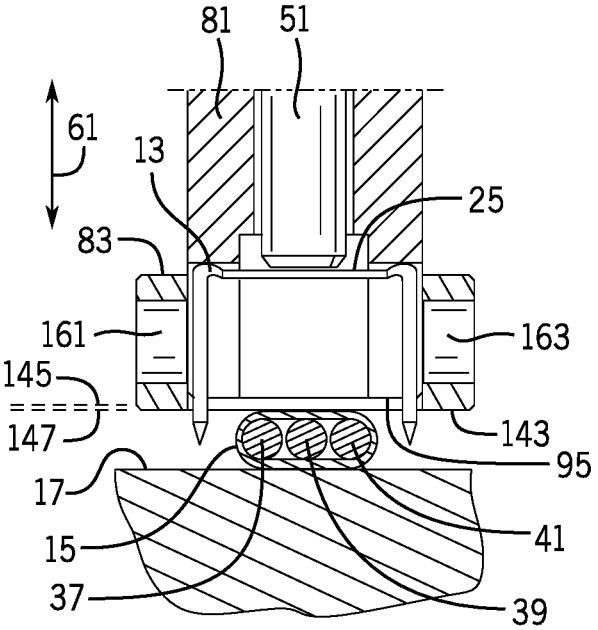
FIGS. 4A-4C are section views taken along section 4A-4A of FIG. 7

Referring to FIGS. 1-2, 4A-7, and 9-22, one example of a fastener carrier 10 tool according to the invention is illustrated. Fastener carrier 10 is referred to herein interchangeably as a fastener carrier, or simply as a carrier. Carrier 10 may be a component of a fastener driver 11, such as that illustrated in FIGS. 1-2 and 4A-8, or another fastener-driving tool. Carrier 10 may be used to hold and potentially guide fasteners, such as staple 13, during fastener driving by driver 11. Staple 13 may be of a type used to secure a workpiece, such as an electrical cable 15, 15*a*, 15*b* (FIGS. 4A-5C), to a surface 17, such as a stud or joist made of wood or other material into which staple 13 may be driven. As used herein, "workpiece" refers to the article or thing being secured by the fastener.

Carrier 10 of the types described herein can enable "hands-free" driving of staples 13 in a manner which is far more rapid and efficient than through use of a conventional hammer. Improvements in efficiency are of great importance, particularly when a construction or other project may involve driving hundreds or thousands of fasteners such as staple 13. By way of example only, an electrician may be required to drive hundreds of staples 13 to complete an electrical wiring project during construction of a commercial or residential structure.

Carrier 10 may include "depth limiter" structure which can be implemented to consistently and repeatably limit the driven depth of the staple 13 relative to, or with respect to, cable 15 or other workpiece being secured. Staple 13 will be driven a greater, or a lesser, distance into the stud, joist or other surface 17 depending on the thickness of cable 15 or other workpiece being secured, but the securement provided by staple 13 relative to cable 15 or other workpiece will be consistent and identical for each and every staple 13. Such carrier 10 depth limiter structure provides the user with an opportunity to compensate for the "thickness" of staple 13 to thereby limit driving of staple 13 into surface 17 by a selected increment which is preferably equal to, or greater than, the thickness of staple 13. As a result, staple 13 may be quickly driven to hold cable 15, cables 15*a*, 15*b*, or another workpiece, snugly to surface 17 without excessive force that could cut or tear insulator 19 or otherwise damage cables 15 and 15*a* against which staple 13 presses. And, such carrier 10 depth limiter structure provides for a consistent staple depth limitation relative to the cables 15, 15*a*, 15*b* or other workpiece even as the thickness of such cables 15, 15*a*, 15*b* or other workpiece varies as can be understood by a comparison of FIGS. 4A-5C.

Before providing a fuller discussion of carrier 10, examples of staple-type 13 fasteners which may be consistently driven using carrier 10 will be described. Referring then to FIGS. 3 and 4A-5C, non-limiting examples of staples 13 and 13*a*, 13*b* which may be driven using carrier 10 are illustrated. Staple 13 (and staples 13*a*-13*b*) may be referred to as a standard cable staple. Staple 13 may include a pair of legs 21, 23 joined together by a crown 25 providing staple 13 with a generally U-shaped appearance. Each leg 21, 23 may end in a sharpened tip 27, 29 to facilitate driving of staple 13 into a surface 17 such as a wood stud, joist or any other surface into which a fastener could be driven. Crown 25 may include a "flat" or flattened section 31 between legs 21, 23 which may be a widened portion of crown 25 ideal for striking to drive fastener 13.

By way of non-limiting examples, standard cable staples are frequently made of ferrous steel wire having a gauge of from about 10 gauge (0.135 inch nominal) and about 13 gauge (0.090 inch nominal) both for heavy duty wire staples to about 22 gauge (0.029 inch nominal) for light duty fine wire staples. For standard cable staples, the "thickness" of staple 13 for which carrier 10 can compensate refers to the thickness dimension (D) of crown 25 between upper 33 and lower 35 surfaces of crown 25 and is typically a measure of the gauge of the wire used to form staple 13. The thickness dimension (D) of crown 25 can be increased to an amount greater than the gauge of the wire by bending of the wire to form the crown 25 as illustrated in FIG. 3. Therefore, a heavy duty staple of 13 gauge wire would have a nominal maximum thickness dimension at crown 25 of about 0.090 inch based on the gauge of the wire together with any increase in thickness resulting from bending of the wire. The thickness dimension (D) of crown 25 can be further increased, for example, by inclusion of an insulator component on crown 25 (not shown).

Also by way of non-limiting examples, staple 13 may be available with many different crown 25 lengths between legs 21, 23, for example from 7/16 inch to 1 inch for heavy duty wire staples to about 3/16 inch to about 3/8 inch for light duty fine wire staples. Leg 21, 23 length between crown 25 and respective tips 27, 29 may vary from, for example, from 5/8 inch to 2½ inch for heavy duty wire staples to about 3/16 inch to about 1½ inch for light duty fine wire staples.

The staples 13-13*b* illustrated in FIG. 3 all have identical crown 25 lengths and thickness dimensions (D) but have different leg 21, 23 lengths. Each such staple 13-13*b* may be driven to a consistent depth relative to a cable 15, 15*a*, 15*b* or other workpiece using carrier 10. Carrier 10 is not limited to use with staples 13-13*b* and may be used or adapted for use with a complete range of staples including, without limitation, nob staples, service cable staples, long leg nob staples, insulated nob staples, insulated staples, and super staple cable staples. While carrier 10 is described in connection with staple 13 type fasteners, carrier 10 could be utilized with any fastener where compensation for the thickness of the fastener driven end is desired. One such non-limiting example could be a cleat provided with an "L-shaped" driven end.

FIGS. 4A-4D and 5A-5C illustrate examples of electrical cables 15 and 15*a*, 15*b* which may be secured with a staple 13 to a surface 17 by an electrician or other tradesperson using a driver 11 equipped with carrier 10. Cables 15, 15*a*, 15*b* may be Romex type thermoplastic-sheathed cable (TPS) as described above. In the examples, cables 15, 15*a*, 15*b* may have a pair of conductors 37, 39 and a ground wire 41 sheathed by a TPS insulator 19. Such cables 15, 15*a*, 15*b* may be provided in a variety of sizes known in industry, examples of which are referred to as 14-2, 12-2, and 10-2 sizes, where the 14, 12, and 10 refers to the gauge of the conductor. As is known, 10 gauge is a thicker conductor than 14 or 12 gauge conductors.

Figure 5A:
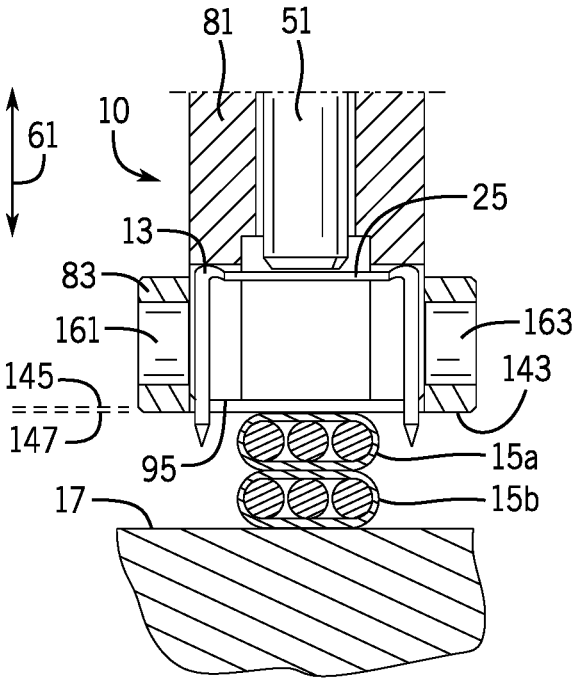
FIGS. 5A-5B are section views taken along section 5A-5A of FIG. 7
Figure 5B:
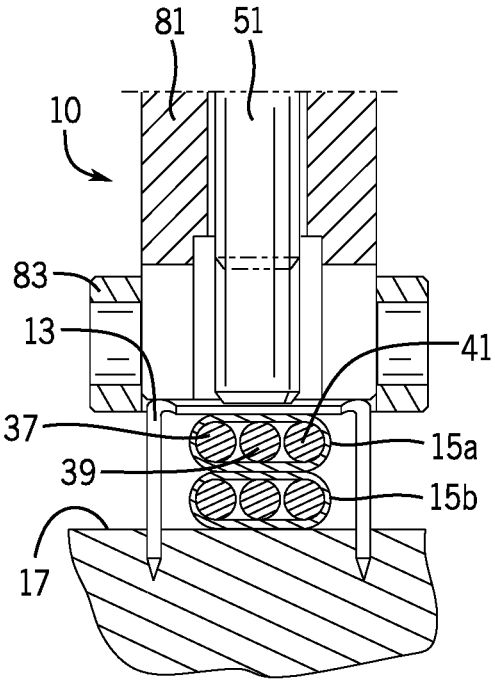
Figure 5C:
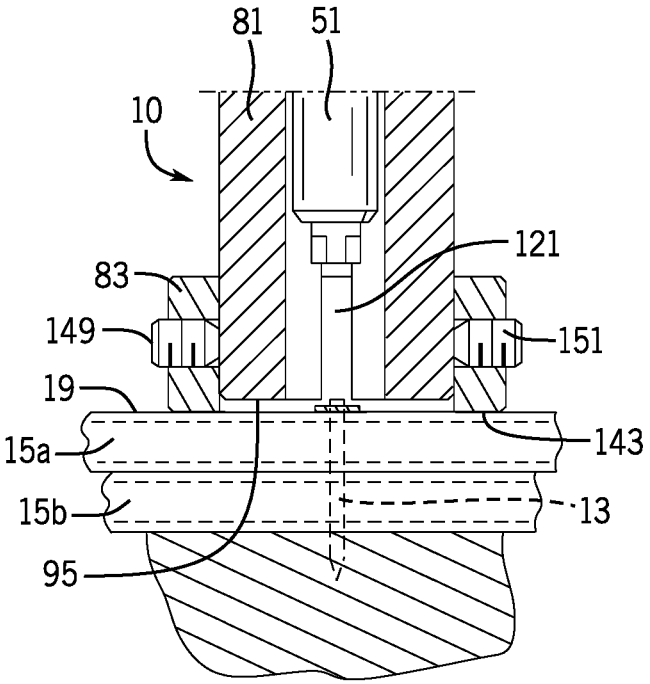
FIG. 5C is a section view taken along section 5C-5C of FIG. 7 and FIGS. 5A-5C illustrate driving of a staple-type fastener to secure a pair of stacked Romex cables to a surface.

As illustrated in FIGS. 5A-5C, a stack of two cables 15*a*, 15*b* may be secured to surface 17 by a single staple 13 which has legs 21, 23 of the same length as those of staple 13. Carrier 10 is capable of driving all of the staples 13-13*b* to a consistent and repeatable depth relative to one cable 15 or a stack of cables 15*a*, 15*b*, providing compensation for the thickness dimension (D) of the staple crown 25 so that crown 25 is not driven into or through insulator 19, thereby avoiding damage to cable 15.

Turning next to FIGS. 1-2A and 4A-8, a non-limiting example of a driver 11 (a fastener-driving tool) with which a carrier 10 may be used will now be described. Driver 11 illustrated in FIGS. 1-2A and 4A-8 may be a Model M12 "palm nailer" available from Milwaukee Electric Tool Corporation of Brookfield, Wis. As is known, the Model M12 is a nail driver and lacks any depth limiter capability. As illustrated in FIGS. 1-2A and 4A-8, carrier 10 may be a direct replacement for the "collet" part supplied by Milwaukee Electric Tool Corporation with the model M12 driver 11, thereby converting the M12 driver 11 for use with staples 13 rather than with nails. Such "collet" holds a fastener manually placed therein by a user loosely with magnetic attraction preventing the fastener from falling out of the collet when the driver 11 is turned toward the surface (e.g., surface 17) for fastener driving. Driver 11 of FIGS. 1-2A and 4A-8 may be of a lightweight, compact design capable of being held in a user's hand and making driver 11 ideal for driving a staple 13 in a confined space, such as those spaces within a wall, a ceiling, or a floor.

Other non-limiting examples of commercially-available fastener-driving tools which may be used with a carrier 10 of the types described herein may include a Bostitch Stanley PN100 impact nailer, a Hitachi Model NH 90AB bulk nailer, a Senco PC0781 hand nailer, and a Central Pneumatic Model 90193 air mini hand nailer. In each of these examples, carrier 10 may be configured as a direct replacement for the original nail holder or nail guide part supplied with the driver by the manufacturer. Therefore, a carrier 10 may be a replacement for the PN100 "nose" part, the NH 90AB "rod" part, the PC0781 "guide" part, and the Model 90193 "guide bushing" part. It will be appreciated that an original fastener-driving tool may be constructed to include a carrier 10 as an integral component.

Returning to FIGS. 1-2A and 4A-8 the Model M12 driver 11 illustrated therein will next be described in further detail. Because a driver 11 such as the Model M12 is a commercially-available product and for convenience and brevity, only those portions of driver 11 which directly interact with carrier 10 are described in detail in the following passages. As illustrated in FIGS. 1-2 and 6-7, driver 11 may include a housing 43 enclosing a motor (not shown). The motor may be an electrically-powered motor and such motor may drive a rotatable hammer with a pair of outwardly extending striking elements (not shown) through a suitable gearcase. The motor may be powered by an onboard rechargeable power source such as a battery (not shown), and the driver 11 may include an electronic control board (not shown), an on/off switch 45, and any other desired parts, such as strap 47 optionally provided to assist a user with holding the driver 11 in one hand.

Referring to FIGS. 4A-6, an anvil assembly 49 may support an inwardly-biased anvil 51 for reciprocating axial movement. Anvil 51 may be biased toward the hammer (i.e., inwardly-biased) by a spring (not shown) within assembly 49. Anvil 51 is preferably a cylindrical, rod-like part that may include a circular proximal end 53 which is struck by the striking elements and a circular, flattened distal end 55 which strikes the fastener, such as staple 13 in the examples.

In the driver 11 examples of FIGS. 1-2A and 4A-8, rotation of the hammer by the motor, causes the striking elements to intermittently strike anvil 51 proximal end 53 driving anvil 51 axially outward from housing 43 toward a fastener while anvil 51 moves axially inward under the influence of the spring when the hammer striking elements are out of contact with proximal end 53. Repeated intermittent striking of anvil 51 by the hammer causes anvil 51 to rapidly reciprocate for driving a fastener such as staple 13, as described in further detail herein.

While driver 11 of FIGS. 1-2A and 4A-8 is described as an electrically-powered motorized tool, it should be understood that driver 11 could be of another type, such as an air-driven (i.e., pneumatic) tool such as the Bostitch Stanley, Hitachi, Senco and Central Pneumatic drivers listed above. In such pneumatic embodiments, an anvil could be associated with a reciprocating piston such that the reciprocating action of anvil 51 drives a fastener, such as staple 13, into surface 17.

Referring now to FIGS. 1-2A and 6-8, there is shown exemplary structure for securing carrier 10 with respect to driver 11. Sleeve 57 may be provided to secure carrier 10 with respect to driver 11 and to allow back-and-forth axial movement of carrier 10 with respect to housing 43 along axis 59 alternatively in the directions of dual-headed arrow 61. Sleeve 57 may have a generally cylindrical structure with an outer wall 63 including outside threads 65 provided to mesh with inside threads (not shown) of anvil assembly 49 and an inner wall 67 defining an axial smooth-walled cylindrical bore 69 with an inside diameter 71. A distal end sleeve 57 wall 73 may have a circular edge 75 defining a circular opening 77 normal to axis 59 but having an inside diameter 79 less than bore 69 inside diameter 71. Sleeve 57 inner wall 67 and the sleeve 57 end wall circular edge 75 serve as guide surfaces enabling sliding back-and-forth axial movement of carrier 10 with respect to housing 43 alternately in the directions of dual-headed arrow 61, as described in more detail below.

A carrier 10 example according to the invention will now be described in connection with FIGS. 1-2A, 4A-7 and 9-22. In embodiments, carrier 10 may include a fastener holder 81 and a collar 83. Collar 83 is also referred to herein as a "fastener depth limiter" of just "depth limiter". Holder 81 may cooperate with sleeve 57 to secure carrier 10 with respect to driver 11 and to allow the aforementioned sliding back-and-forth axial movement of carrier 10 wherein holder 81 may extend out from housing 43 and retract toward housing 43. Holder 81 may hold a staple 13 during the fastener driving. Holder 81 may also serve as a guide to ensure staple 13 is being driven in the desired direction and path. In the example, holder 81 may have a body 85, which may be elongate along holder 81 axis 87. In certain non-limiting embodiments, collar 83 may be of an annular-type coaxial with axis 87. Collar 83 may cooperate with holder 81 to limit the depth of staple 13 driving in a consistent and repeatable manner relative to the cable 15, cables 15, 15*b*, or other workpiece being secured.

Referring to FIGS. 6-18, holder 81 body 85 may define an outer wall 88 and a flange 89. Outer wall 88 and flange 89 of body 85 may cooperate with sleeve 57 to allow the axial movement of holder 81. Outer wall 88 of holder 81 body 85 may have a generally cylindrical structure or appearance including a proximal end 91 and a distal end 93 defining axis 87 therebetween. Distal end 93 may have a face 95. Flange 89 with an annular outer edge 97 may extend outward from outer wall 88 proximate proximal end 91. Outer wall 88 may define an outside diameter 99 which may be slightly less than inside diameter 79 of sleeve 57 end wall 73 opening 77 while flange 89 annular outer edge 97 may define outside diameter 101 which is slightly less than inside diameter 71 of bore 69. Holder 81 may be slidingly inserted within sleeve 57 bore 69 with holder 81 outer wall 88 slidingly through the distal end sleeve wall 73 circular opening 77 constrained by the sleeve 57 end wall 73 circular edge 75, and with flange 89 annular outer edge 97 slidingly against and constrained by bore 69 inner wall 67, collectively enabling the sliding back-and-forth axial movement of carrier 10 in the directions of dual-headed arrow 61 with respect to housing 43.

Holder 81 may be limited from falling out of sleeve 57 by co-action of sleeve 57 distal end wall 73 and flange 89 within sleeve 57 bore 69. An advantage of the cylindrical shape of holder 81 and circular opening 77 of distal end sleeve 57 distal end wall 73 is that, in addition to the sliding back-and-forth axial movement of carrier 10 in the directions of arrow 61, holder 81 and carrier 10 may rotate 360° about, or normal to, axis 59. Such rotation of carrier 10 enables the user to rotate carrier 10 independent of housing 43 to position a U-shaped staple 13 with legs 21, 23 straddling cable 15.

Figure 6:
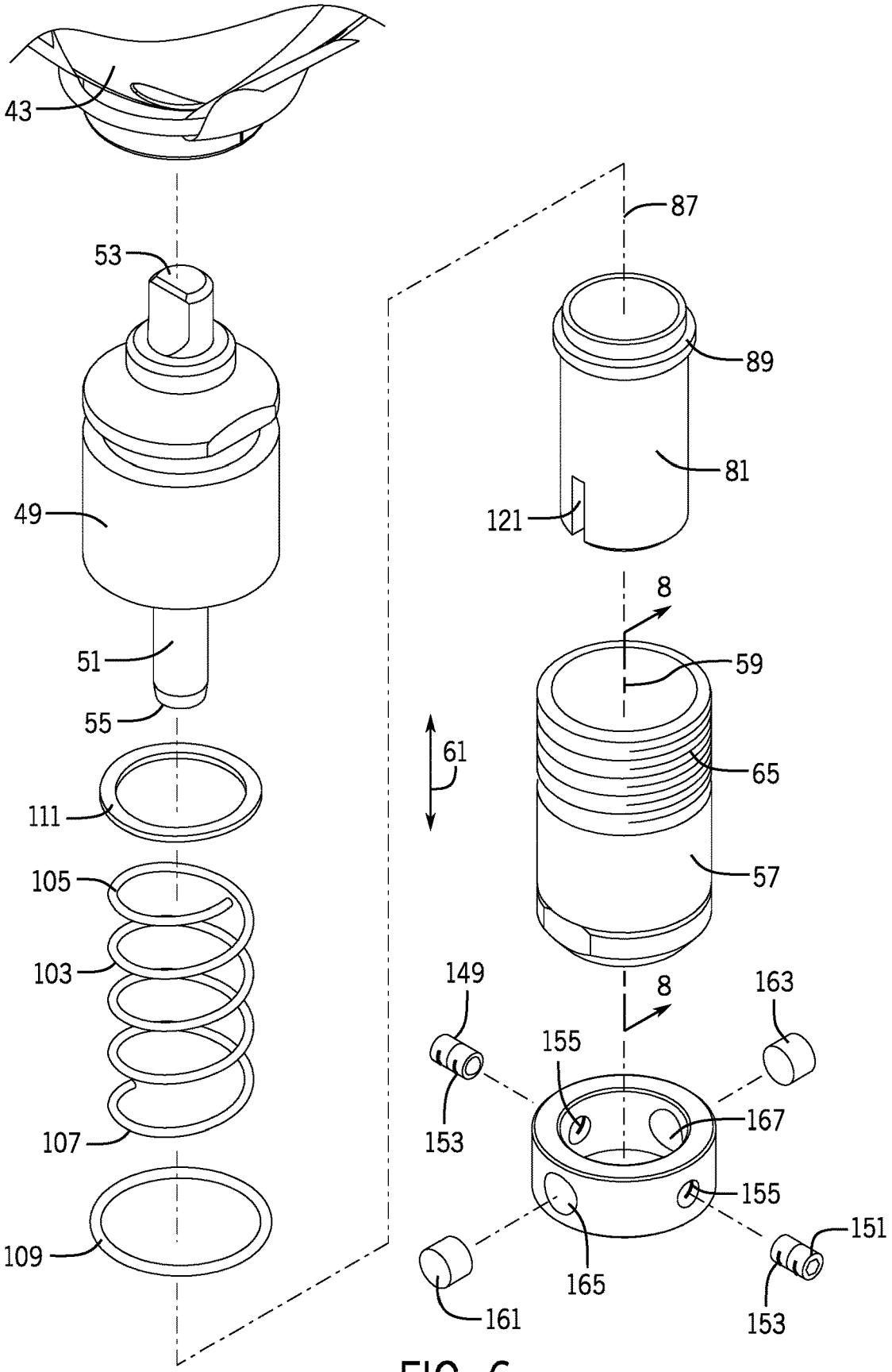
FIG. 6 is an exploded view of portions of the fastener-driving tool and carrier of FIG. 1.
Figure 7:
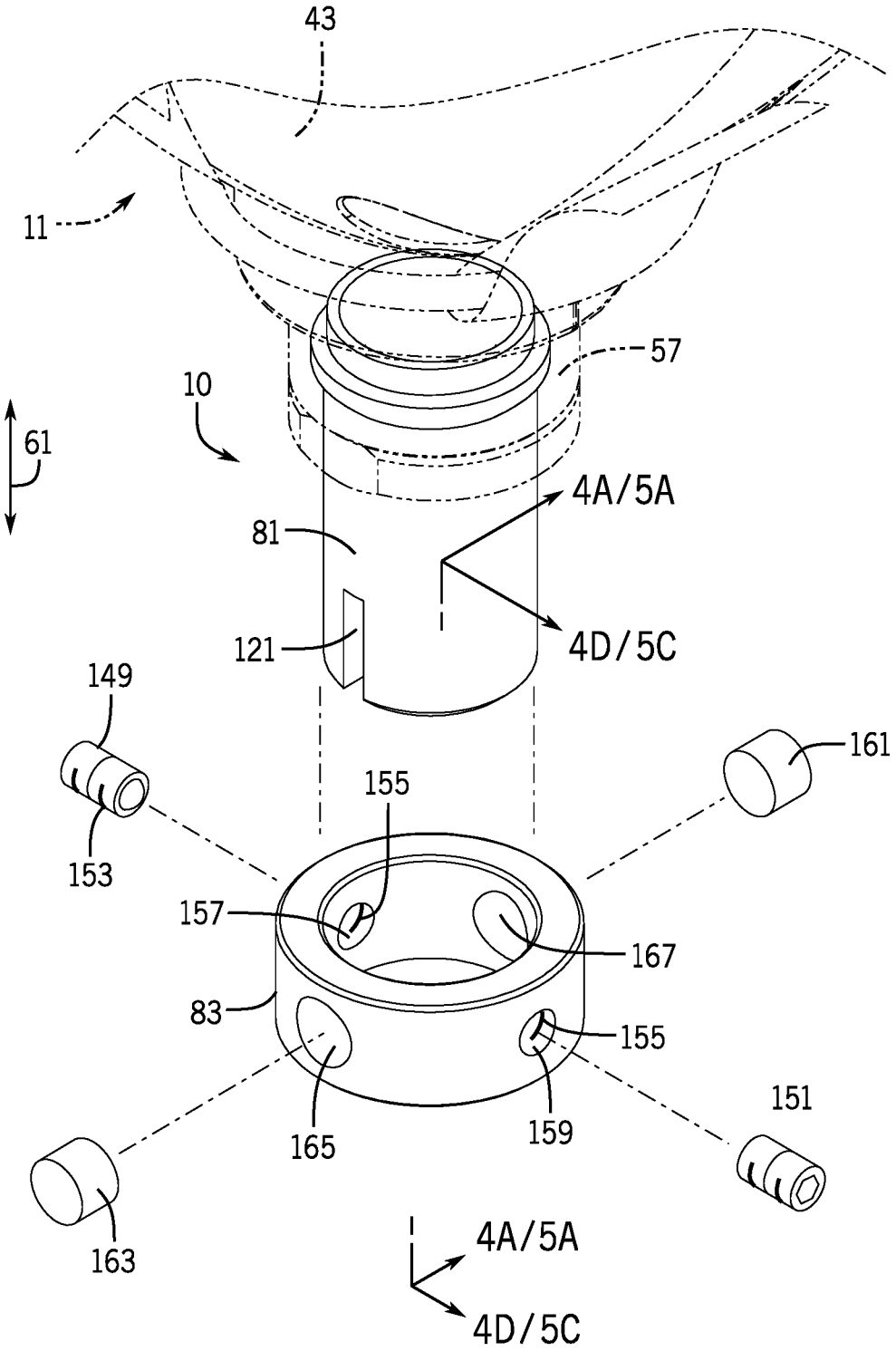
FIG. 7 is a further exploded view of portions of the fastener-driving tool and carrier of FIG. 1.
Figure 9:
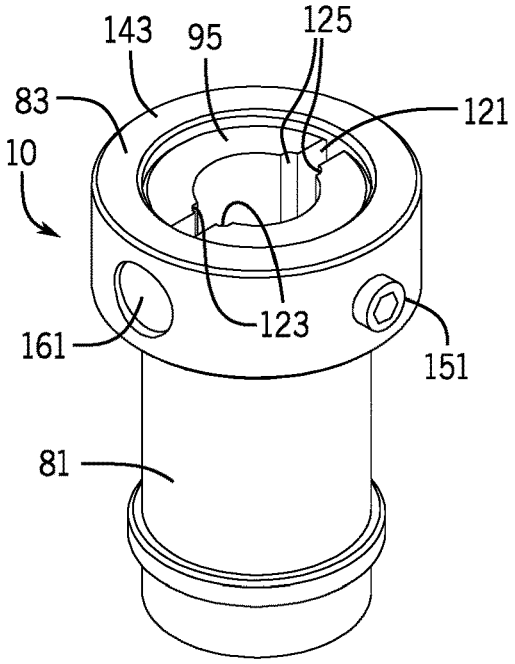
FIG. 9 is a perspective view of the carrier of FIG. 1 apart from the fastener-driving tool.
Figure 10:
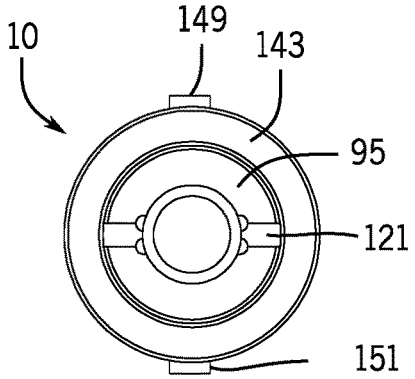
FIG. 10 is a distal end plan view of the carrier of FIG. 9.
Figure 11:
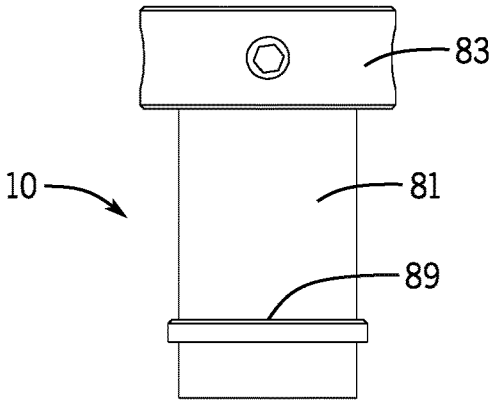
FIG. 11 is a side elevation view of the carrier of FIG. 9.

Referring to FIG. 6, carrier 10 may be biased away or outward from housing 43 by compression spring 103, a proximal end 105 of which may press against anvil assembly 49 and the distal end 107 of which may press against proximal end 91 of holder 81 or against flange 89 of holder 81. An O-ring 109 and washer 111 may also be provided. Twisting detachment of sleeve 57 from anvil assembly 49 enables a user to remove a conventional nail-holder-type collet and to replace it with an inventive carrier 10.

Figure 14:
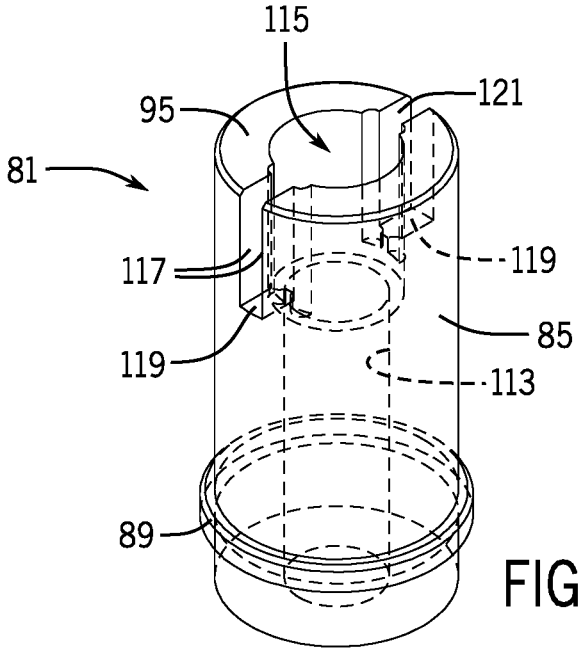
FIG. 14 is the perspective view of the holder of FIG. 13 but showing certain internal features in broken line.
Figure 15:
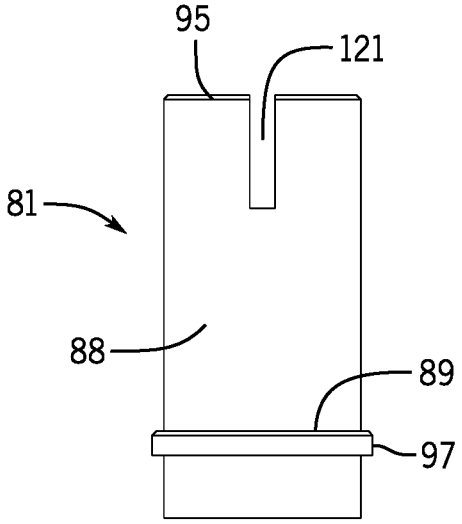
FIG. 15 is a side elevation view of the holder of FIG. 13.
Figure 16:
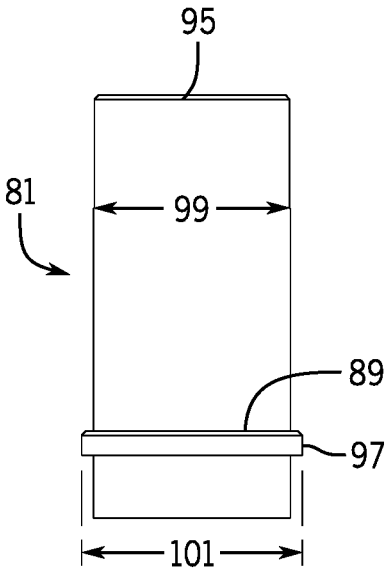
FIG. 16 is a further side elevation view of the holder of FIG. 13.
Figure 17:
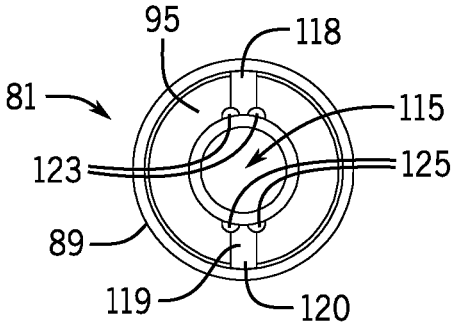
FIG. 17 is a distal end plan view of the holder of FIG. 13.
Figure 18:
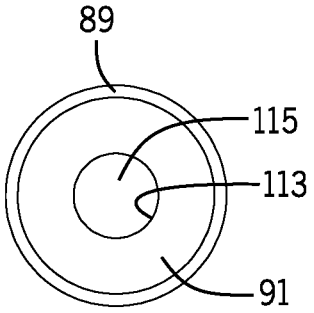
FIG. 18 is a proximal end plan view of the holder of FIG. 13.

Referring now to FIGS. 2A, 4A-7 and 9-18, carrier 10 holder 81 may have an inner wall 113 defining an axial smooth-walled bore 115 coaxial with axes 59, 87 which may be of a cylindrical shape or a stepped cylindrical shape, the latter being illustrated in FIG. 14. The narrower bore 115 closer to holder 81 proximal end 91 may serve as a guide surface for reciprocating anvil 51. When holder 81 is secured within sleeve 57, anvil 51 extends through bore 115 such that anvil 51 distal end 55 can contact staple 13 crown 25 for purposes of driving staple 13 into surface 17. In the examples, anvil 51 has a predetermined and finite outward axial stroke. Anvil 51 contacts staple 13 as holder 81 retracts toward housing 43 when a user presses against housing 43 during fastener driving. Holder 81 body 85 may have a length between proximal 91 and distal 93 ends selected so that the maximum stroke of anvil 51 is to the distal end 93 of body 85 when holder 81 is fully retracted.

Referring to FIGS. 2A, 4D, 5C, 13-15 and 17, holder 81 may further include side 117 and shelf 119 surfaces defining a fastener-receiving opening which may be a slot 121. Slot 121 may have a length dimension parallel to holder axis 87 from shelf 119 to the holder 81 face 95 and a width dimension normal to holder 81 axis 87 from shelf 119 to the holder 81 face 95 for purposes of receiving a staple 13 therein and holding legs 21, 23 and crown 25 of a staple 13 seated in slot 121. Side surfaces 117 may be spaced apart to provide gaps 118, 120 which each receives a respective leg 21, 23 therein. Slot 121 enables "hands-free" fastener driving by holding staple 13 during the driving process after a user places a staple 13 in slot 121. Slot 121 may be sized as desired to accommodate one or a plurality of staple 13 sizes. For example, gaps 118, 120 may be sized to snugly fit a particular size of staple 13, or smaller sized staples 13 held in slot 121 solely by magnets 161, 163 may be utilized.

Before driving, and as illustrated in FIGS. 4A and 5A, anvil 51 distal end 55 may be initially spaced inward from slot 121 near or spaced from a staple 13 placed in slot 121 by the user. During driving, holder 81 retracts axially along axis 59 toward housing 43 with maximum holder 81 travel limited by full compression of spring 103. With spring 103 fully compressed, anvil 51 distal end 55 may extend no further than holder 81 face 95 as illustrated in FIGS. 4C and 5B. Thus, and in the examples, the maximum driving stroke of anvil 51 is the distal end 93 face 95 of holder 81.

Referring to FIGS. 2A, 3, 9-10, 13-14, and 17, two pairs of recesses 123, 125 may be provided in body 85 within bore 115 adjacent slot 121. Recess pairs 123, 125 may be between face 95 of holder 81 and shelf 119. If provided, recess pairs 123, 125 can allow for clearance of any widened ends 127, 129 of flat section 31 of crown 25 as illustrated in FIG. 3. Recess pairs 123, 125 are illustrated as including curved walls facing bore 115 (i.e., with radii) but could have other shapes, such as squared walls, such as to accommodate the insulated staples which may have squared off insulators adjacent crown 25.

Referring next to FIGS. 1-2A, 4A-7, 9-12B, and 19-22, carrier 10 collar 83 may have an annular, or ring-type, configuration with an inner wall 131 defining an axial smooth-walled bore 133 which may be of a cylindrical shape. When mounted on holder 81, collar 83 may be coaxial with axes 59, 87. In the examples, inside diameter 135 of bore 133 may be slightly larger than outside diameter 99 of holder 81, allowing collar 83 to slide axially back-and-forth over holder 81 in the directions of arrow 61.

Collar 83 may further have a circular outer surface 137, a proximal end 139 and a distal end 141 defining a face 143. Collar 83 distal end 141 may be considered workpiece-contacting because in the examples, distal end 141 and face 143 contact cable 15, 15*a* or other workpiece to limit the depth of fastener 13 driving. Holder 81 face 95 and collar 83 face 143 may each define a plane 145, 147. Planes 145, 147 may be parallel when collar 83 face 143 is spaced from holder 81 face 95 in the examples.

While the "depth limiter" as illustrated is of an annular collar-type 83, it is envisioned that a collar 83 could be implemented in other ways. For example, collar 83 outer wall 137 may be of a square-type or other shape while inner wall 131 could be configured to complement holder 81 bodies 85 of cylindrical shapes or shapes other than of a generally cylindrical-type (e.g. a rectangular-type or an octagonal-type). Depth limiter need not be of a collar-type 83 as illustrated and could be of other structure that cooperates with holder 81 to compensate for the thickness dimension (D) of a fastener, such as staple 13 (e.g., a segmented collar or a single segment secured to holder 85).

Referring to FIGS. 2, 9 and 12A-12B, when limitation of the depth of fastener 13 driving is desired, collar 83 may be positioned on holder 81 such that collar 83 face 143 extends past, or outward from, holder 81 face 95. In the examples, the axial spacing of collar 83 face 143 from holder 81 face 95, and the resultant parallel spacing of planes 145, 147, may be in an amount equal to or greater than the thickness dimension (D) of crown 25. In such examples, the offset of collar 83 face 143 from holder 81 face 95 serves to limit the depth of each driven staple 13 because, when holder 81 is fully retracted toward housing 43, the maximum driving stroke of anvil 51 is at face 95 of holder 81 and face 95 is spaced from cable 15 or other workpiece by collar 83, limiting staple 13 driving to a consistent and repeatable depth relative to cable 15, cables 15*a*, 15*b*, or other workpiece.

Figure 12A:
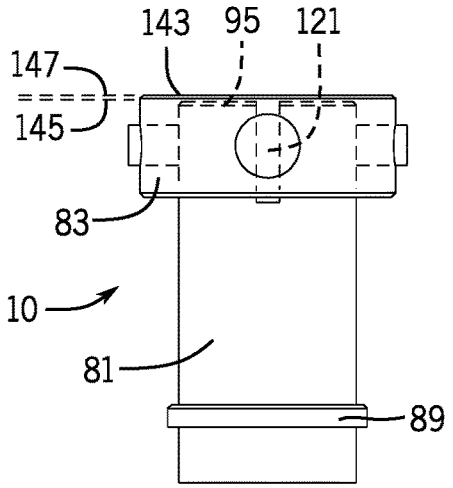
FIGS. 12A-12B are a side elevation views of the carrier of FIG. 9 with certain internal features in broken line showing the collar in different positions.
Figure 12B:
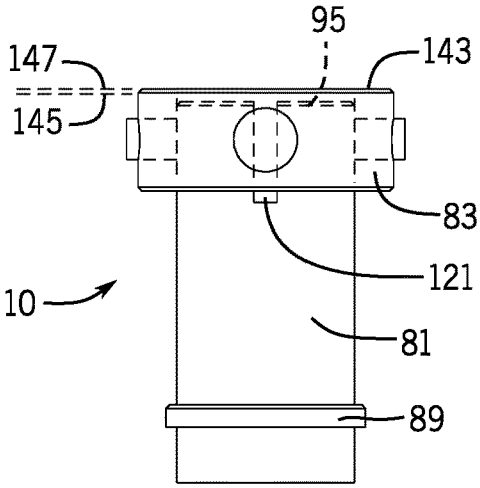
Figure 13:
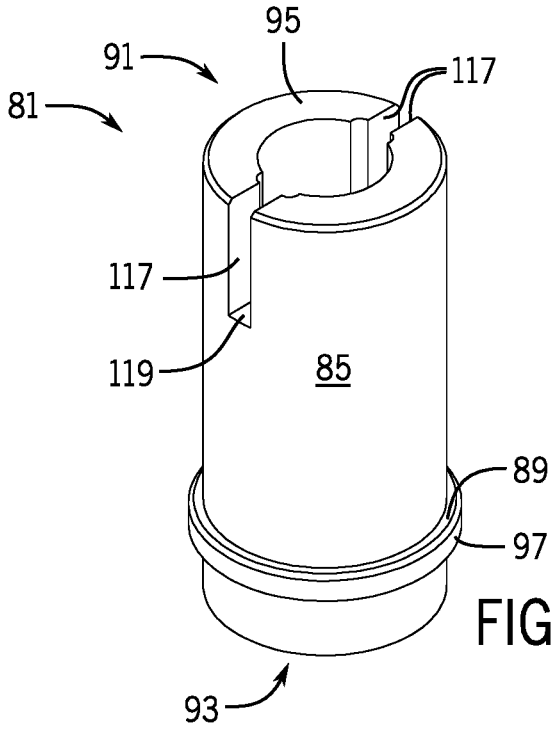
FIG. 13 is a perspective view of a carrier holder.

FIGS. 12A and 12B illustrate two different axial positions of the same collar 83 on the same holder 81. According to FIG. 12A, collar 83 face 143 and plane 147 are spaced outward from holder 81 face 95 and plane 145 by a first distance. According to FIG. 12B, collar 83 face 143 and plane 147 are spaced outward from holder 81 face 95 and plane 145 by a second distance which is greater than the first distance. FIGS. 12A-12B illustrate that the user may select the position of collar 83 on holder 81 to accommodate staples 13 having crowns 25 of different thickness dimensions (D) with the spacing being less for crowns 25 having a lesser thickness dimensions (D) and the spacing being greater for crowns 25 having a greater thickness dimension (D).

Holder 81 and collar 83 of carrier 10 may be made of any suitable material. By way of non-limiting example, D2 tool steel heat treated to a Rockwell hardness of 58-62 may be utilized.

Referring to FIGS. 1, 2A, 4D, 5C-7, 9-12B and 19-22, collar 83 may be held in a fixed position on holder 81, such as the two different positions illustrated in FIGS. 12A and 12B, by means of a stop member which may be one or more set screw 149, 151. Set screws 149, 151 may have threads 153 which mesh with threads 155 in respective bores 157, 159 to hold collar 83 in a fixed position relative to holder 81.

Rare earth magnets 161, 163 may be provided to hold ferrous metal staples 13 in carrier 10 slot 121, even if carrier 10 is facing downwardly prior to fastener driving. Magnets 161, 163 are useful to prevent a staple 13 from falling out of carrier 10 slot 121 before fastener driving. If provided, magnets 161, 163 may be press fit in respective openings 165, 167 of collar 83.

Use and operation of carrier 10 will now be described in connection with the examples of FIGS. 1-22. If a conventional "palm nailer" type driver 11, such as the Milwaukee model M12 driver 11 is to be utilized, then the user may first remove the supplied "collet" and may replace it with a carrier 10 according to the invention. Such a replacement could also be made for the Bostitch Stanley, Hitachi, Senco, and Central Pneumatic drivers described previously. To make the exchange for the Model M12 driver 11 and as previously described, sleeve 57 may be twisted and detached from anvil assembly 49. Once removed, sleeve 57 may be tipped so that the supplied "collet" slides out of sleeve 57 bore 69.

Next, holder 81 without collar 83 attached thereto may be inserted into sleeve 57 bore 69 with holder 81 extending through opening 77 in sleeve 57 distal end wall 73. Contact between holder 81 flange 89 and distal end wall 73 limits outward movement of holder 81. Also and as previously described, holder 81 may be sized such that holder 81 outside diameter 99 is slightly smaller than opening 77 inside diameter 79, and flange 89 outside diameter 101 may be slightly smaller than bore 69 inside diameter 71. In such an example, holder 81 may slide easily back-and-forth within sleeve 57 in the directions of dual-headed arrow 61 with holder 81 outer wall 88 riding against sleeve 57 edge surface 75 defining opening 77 and flange 89 riding against inner wall 67 of sleeve 57. O-ring 109 may be fitted around holder 81 outer wall 88 between distal end wall 73 and flange 89 to block debris from entering sleeve.

With holder 81 inserted into sleeve 57 through sleeve 57 distal end wall 73 opening 77, compression spring 103 and washer 111 may next be inserted into sleeve 57 with washer 111 between spring 103 proximal end 105 and anvil assembly 49 to provide a wear surface protecting anvil assembly 49 from wear by spring 103.

Next, sleeve 57 and holder 81 are pressed toward anvil assembly 49 with anvil 51 inside spring 103 and holder 81 bore 115. Sleeve 57 is then twisted to engage sleeve threads 65 with corresponding threads (not shown) of anvil assembly 49 to secure sleeve 57 on driver 11. With sleeve 57 secured to anvil assembly 49, spring 103 is compressed with spring 103 distal end 107 against holder 81 proximal end 91 and spring 103 proximal end 105 against washer 111 which is against anvil assembly 49 to apply a force biasing holder 81 outward from anvil assembly 49 until stopped by contact between sleeve 57 distal end wall 73 and holder 81 flange 89. Anvil 51 is free for reciprocating movement within holder 81 bore 115 alternately in the directions of dual-headed arrow 61. Anvil 51 distal end 55 is initially spaced apart and inward from holder face 95 in the examples.

Next, collar 83 may be attached to holder 81. Collar 83 provides depth limiter structure for carrier 10. In the examples, collar 83 inner wall 131 is fitted over holder 81 outer wall 88. In the examples, it is desirable that collar 83 slidingly fits over holder 81 with minimal or no lateral play. The user may then slide collar 83 toward holder 81 proximal end 91 of anvil assembly 49 and toward driver 11.

In the examples, the depth to which the fastener may be driven is limited by the relationship between collar 83 face 143 and holder 81 face 95 given that the maximum driving stroke of anvil 51 distal end 55 is flush with (i.e., co-planar with) holder 81 face 95. Collar 83 face 143, when located past holder 81 face 95, contacts cable 15 and spaces holder 81 face 95 and anvil 51 distal end 55 from cable 15 or other workpiece, thereby limiting further staple 13 driving toward cable 15 and into surface 17. Since collar 83 may be located in one selected axial position on holder 81, each and every staple 13 will be driven to a consistent and repeatable limited depth relative to cable 15, 15*a*, 15*b* or other workpiece. Because the depth limiter structure 83 functions with respect to the cable 15, 15*a*, 15*b* (or other thing being secured), staple 13 is always driven to a consistent and repeatable position with respect to that cable 15, 15*a*, 15*b* or workpiece, irrespective of the thickness of cable 15 or cables 15*a*, 15*b*, or another workpiece or thing.

For example, if the user desires that staple 13 is driven into surface 17 such that crown 25 is snug against insulation 19 of cable 15 and crown 25 has a thickness dimension of 0.090 inch, then collar 83 may be located on holder 81 such that collar 83 face 143 is beyond holder 81 face 95 by an axial amount of 0.090 inch. Alternatively, if it is desired that staple 13 is driven into surface 17 such that crown 25 loosely holds cable 15 providing a gap between crown 25 and insulation 19, then the axial spacing between collar 83 face 143 and holder 81 face 95 may be greater than 0.090 inch.

Collar 83 may be secured to holder 81 with collar 83 face 143 in the desired fixed position relative to holder 81 face 143 by tightening set screws 149, 151 (i.e., stop members). Holder 81 is initially extended fully outward from housing 43 and anvil assembly 49 by spring 103 with anvil 51 distal end 55 spaced inward from holder 81 face 95. Driver 11 is now ready for fastener driving.

While desirable to avoid excessive driving of staple 13, use of the depth limitation capability of carrier 10 is not required. In the examples, collar 83 may be located on holder 81 such that collar 83 face 143 is coplanar with holder 81 face 95 or behind holder 81 face 95 (i.e., inward from holder 81 face 95), thereby disabling the depth limiter structure. In such applications, carrier still provides excellent holding and directionality of a staple 13 for general driving purposes.

Referring now to FIGS. 4A-5C, driving of a staple 13 will next be described in connection with a single cable 15 (FIGS. 4A-4D) and a pair of stacked cables 15*a*, 15*b* (FIGS. 5A-5C), demonstrating that carrier 10 functions to consistently limit the depth of the staple 13 relative to cables 15, 15*a*, 15*b* or other workpieces of different thicknesses. In these examples, staple 13 is identical throughout FIGS. 4A-5C with leg 21, 23 lengths selected to be sufficiently long to secure cable 15 or cables 15*a*, 15*b* to surface 17.

Referring to FIGS. 4A and 5A, holder 81 is initially fully extended outward from housing 43 and anvil assembly 49 by spring 103 with slot 121 of carrier 10 unloaded. Note that in FIGS. 4A and 5A (and FIGS. 4B-4D and 5B-5C), collar 83 face 143 extends past holder 81 face 95 an axial distance preferably the same as the thickness dimension (D) of staple 13 crown 25.

The user then hand loads a staple 13 into slot 121 with legs 21, 23 in a respective gap 118, 120 until crown 25 contacts shelf 119, with tips 27, 29 of legs 21, 23 extending past collar 83 face 143. If provided, magnets 161, 163 may hold staple 13 in slot 121 even as driver 11 is turned toward surface 17 and carrier 10 is facing down. In embodiments, slot 121 may optionally be provided with gaps 118, 120 sized to snugly hold staple 13 to help prevent staple 13 from falling out of slot 121 when driver 11 is pointed toward surface 17.

As illustrated in FIGS. 4A and 5A, the user next positions driver 11 so that legs 21, 23 straddle cable 15 or 15*a*, 15*b*. Holder 81 may be rotated relative to cable 15, or 15*a*, 15*b* with the user's fingers without twisting driver 11 Ito accomplish the straddling. Tips 27, 29 of legs 21, 23 are facing or against surface 17 depending on the length of legs 21, 23. Collar 83 face 143 will rest directly against insulator 19 if legs 21, 23 are insufficiently long to touch surface 17, as illustrated in FIGS. 4A and 5A. The user then presses against housing 43. The force applied by the user causes holder 81 to retract into housing 43 until anvil 51 distal end 55 presses against crown 25 with the anvil 51 distal end 55 spaced from holder 81 face 95.

Figure 4B:
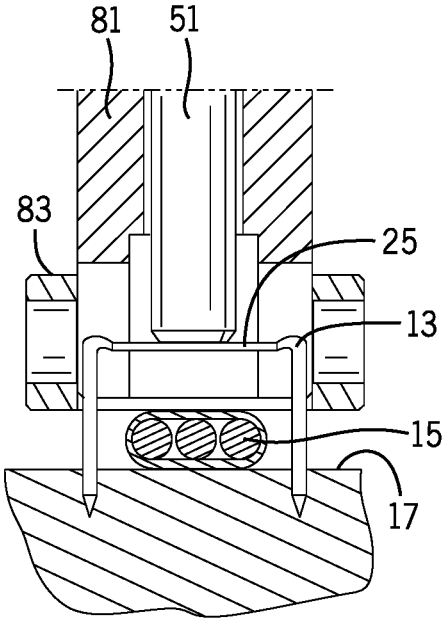
Figure 4C:
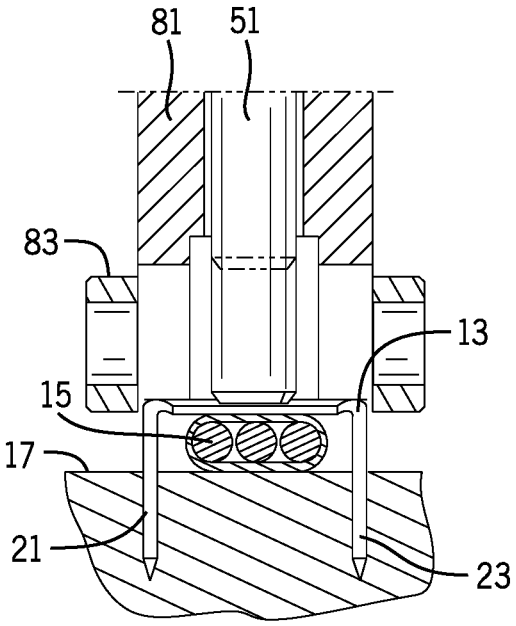

As illustrated in FIG. 4B for the single cable 15 example, the user then moves switch 45 to the "on" position, energizing motor (not shown) to repeatedly reciprocate anvil 51 at high frequency to drive the fastener, namely, staple 13 in the examples. Anvil 51 distal end 55 repeatedly strikes or impacts crown 25, driving staple 13 into surface 17 as the user presses against housing 43. Significant driving force is applied by anvil 51 and by the user pushing against housing 43, causing staple 13 to be rapidly driven into surface 17, especially if surface 17 is a wood product as illustrated in FIGS. 4A-5D.

Driving of staple 13 into surface 17 continues until holder 81 is fully retracted toward housing 43 against spring 103. Driving of staple 13 cannot continue further because, when holder 81 is fully retracted, the maximum stroke of anvil 51 distal end 55 is at face 95 of holder 81.

Figure 4D:
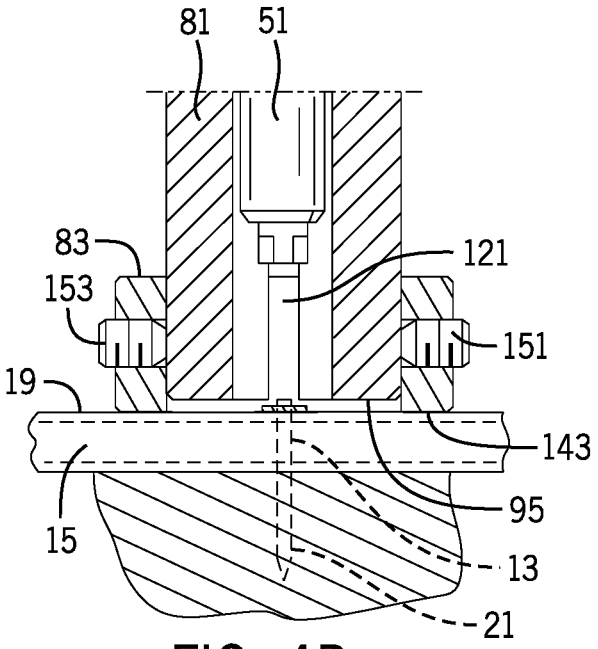
FIG. 4D is a section view taken along section 4D-4D of FIG. 7 and FIGS. 4A-4D illustrate driving of a staple-type fastener to secure a single Romex cable to a surface.

Referring next to FIGS. 4C-4D and 5B-5C, driving of staple 13 into surface 17 continues until both collar 83 face 143 is in contact with insulator 19 of cable 15 (FIGS. 4C-4D) or cables 15*a*, 15*b* (FIGS. 5B-5C) and holder 81 is moved to the fully retracted position just described. Since face 95 of holder 81 and the maximum stroke of anvil 51 are spaced from cable 15 or cables 15*a*, 15*b* by collar 83 face 143, driving of staple 13 is necessarily limited. The section views of FIGS. 4D and 5C are useful to illustrate contact between collar 83 face 143 and insulator 19, with holder 81 face 95 spaced from insulator 19 and holder 81 fully retracted toward housing 43.

Because of the fastener depth limitation provided by carrier 10, staple 13 is prevented from tearing or cutting insulator 19 or otherwise damaging cable 15. Such limitation of staple 13 driving may compensate for the thickness dimension (D) of collar 83 so that cable 15 or cables 15*a*, 15*b* may be consistently and conveniently secured to surface 17 without damage to cables 15, 15*a*, 15*b* or to any other workpiece being secured. Collar 83 can be adjusted on holder 81 as desired so that contact between crown 25 and cable 15 or 15*a* is snug or loose as wanted once staple 13 is driven to the fullest extent permitted by carrier 10. It can be seen that staple 13 in FIGS. 4A-4D is driven further into surface 17 than is identical staple 13 in FIGS. 5A-5C. What is consistent, however, is the relationship between crown 25 of staple 13 and the single cable 15 or the stacked plural cables 15*a*, 15*b* and such consistency is the result of carrier 10.

The foregoing process enabled by carrier 10 may be repeated for each and every staple 13 being driven. Avoidance of damage enabled by carrier 10 avoids costly remedial work and may avoid hazards resulting from cable 15, 15*a*, 15*b* damage, such as property damage by fire or injury to persons. Since carrier 10 may be used with a compact driver 11, the user is enabled to easily drive staples 13 consistently in confined locations where manual swinging of a hammer may not be possible. And, carrier 10 enables very rapid staple 13 driving, saving time compared to use of a manual tool such as a hammer, thereby providing an opportunity for increased efficiency.

The foregoing description is provided for the purpose of explanation and is not to be construed as limiting the invention. While the invention has been described with reference to preferred embodiments or preferred methods, it is to be understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. The disclosed carrier 10 may address some or all of the problems previously described. A particular embodiment need not address all of the problems described, and the claimed carrier 10 should not be limited to embodiments comprising solutions to all of these problems. Further, several advantages have been described that flow from carrier 10 structure and methods of using the carrier 10; the present invention is not limited to structure and methods that encompass any or all of these advantages. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed is:

1. A carrier for holding a staple-type fastener during repeated fastener driving strokes by a fastener-driving tool and limiting the depth to which the staple is driven relative to a workpiece being secured between a crown and legs of the staple and against a surface by the staple, the carrier comprising:

a fastener holder configured for axial back-and-forth movement with respect to the fastener-driving tool, the holder having an elongate body, an outer surface, distal and proximal ends defining a body axis therebetween, a staple-receiving elongate slotted opening in the distal end normal to the axis and entirely across the body defining slot openings in the body distal end and through the body outer surface, and an internal anvil-receiving opening coaxial with the axis extending from the proximal end into the staple-receiving slotted opening and to the distal end; and a fastener depth limiter having a workpiece-contacting distal end and extending at least partially around the outer surface of the body of the holder, the depth limiter being secured to and against the body at one of a plurality of axial positions at which the workpiece-contacting distal end is spaced axially outward from the holder distal end a distance approximately the same as a thickness dimension of the crown of the staple to thereby limit the depth to which the staple can be driven by a maximum anvil stroke by the distance of the spacing, thereby enabling driving of the crown snugly against the workpiece to hold the workpiece against the surface between the crown and legs of the staple without damage to the workpiece.

2. The carrier of claim 1 wherein the workpiece is a cable having outer insulation and the crown snugly holds the cable against the surface free of cutting or damage to the insulation.

3. The carrier of claim 2 wherein the depth limiter is a collar around the body of the holder.

4. The carrier of claim 3 wherein the body has a cylindrical shape and the collar is an annular collar.

5. The carrier of claim 4 wherein the collar has an inside diameter sized such that the collar slides axially over the body outer surface.

6. The carrier of claim 5 wherein the distal end of the holder body and the distal end of the collar are each faces and spacing of the collar distal end face outward from the body distal end face determines the limit of the depth of the fastener driving.

7. The carrier of claim 6 wherein the faces are planar.

8. The carrier of claim 6 wherein the collar further includes a stop member which secures the collar with respect to the body in the one of the plurality of axial positions.

9. The carrier of claim 8 wherein the slotted opening extends entirely across a diameter of the body.

10. The carrier of claim 9 wherein the slotted opening has a width dimension and the width dimension is approximately the same as the thickness dimension of the crown of the staple.

11. The carrier of claim 9 further including a magnet secured to the collar to hold a staple in the slot.

12. The carrier of claim 9 wherein the carrier is biased axially outwardly from the fastener-driving tool.

13. The carrier of claim 12 wherein the body is secured to the fastener-driving tool by a sleeve and the sleeve defines an inner wall sized to allow the axial back-and-forth securement of the body with respect to the fastener-driving tool.

14. The carrier of claim 13 wherein the body has an outward edge proximate the proximal end which coacts with the sleeve to limit outward axial movement of the body with respect to the fastener-driving tool.

15. The carrier of claim 14 wherein the holder and depth limiter secured to and against the holder may rotate 360° about the body axis independent of a housing of the fastener-driving tool to thereby enable positioning of legs of a staple, when in the slotted opening, to straddle the cable without rotating the housing.

16. A fastener-driving tool including a carrier having a fastener depth limiter for holding a staple-type fastener having a crown and opposed legs during repeated fastener driving strokes against the crown by the fastener-driving tool and limiting the depth to which the staple is driven relative to a cable being secured against a surface between the crown and legs of the staple, the tool comprising:

a fastener-driving tool housing;

a driver within the housing an anvil extending outwardly from the housing and driven by the driver;

a sleeve secured to the housing, the sleeve having an inner wall defining an axial bore;

a fastener holder secured to the housing by the sleeve at least partially within the bore configured for axial back-and-forth movement outward from or retracted toward the housing, the holder having an elongate body, an outer surface slidable with respect to the sleeve inner wall, distal and proximal ends defining a body axis therebetween, a staple-receiving elongate slot in the distal end normal to the axis and entirely across the body defining slot openings in the body distal end and through the body outer surface, and an internal anvil-receiving opening coaxial with the axis extending from the proximal end into the slot and to the distal end with the anvil received therein and the maximum stroke of the anvil when the holder is fully retracted is at the holder distal end;

a biasing device biasing the holder outward from the housing; and a fastener depth limiter having a cable-contacting distal end and extending at least partially around the outer surface of the body of the holder, the depth limiter being secured to and against the body at one of a plurality of axial positions at which the cable-contacting distal end is spaced axially outward from the holder distal end a distance approximately the same as a thickness dimension of the crown of the staple to thereby limit the depth to which the staple can be driven by the maximum anvil stroke by the distance of the spacing, thereby enabling the crown to apply a snugging force against the cable which holds the cable against the surface between the crown and legs of the staple without damage to the cable.

17. The fastener-driving tool of claim 16 wherein the depth limiter is a collar around the body of the holder.

18. The fastener-driving tool of claim 17 wherein the body has a generally cylindrical shape and the collar is an annular collar.

19. The fastener-driving tool of claim 18 wherein the collar has an inside diameter sized such that the collar slides axially over the body outer surface.

20. The fastener-driving tool of claim 19 wherein the distal ends of the collar and holder are planar.

21. The fastener-driving tool of claim 20 wherein the collar further includes a stop member which secures the collar with respect to the body in the one of the plurality of axial positions.

22. The fastener-driving tool of claim 21 wherein the slot extends entirely across a diameter of the body.

23. The fastener-driving tool of claim 22 wherein the slot has a width dimension and the width dimension is approximately the same as a thickness dimension of the staple.

24. The fastener-driving tool of claim 22 further including a magnet secured to the collar to hold a staple in the slot.

25. The fastener-driving tool of claim 22 wherein the sleeve axial bore is circular and the generally cylindrically-shaped holder is free to rotate 360° within the axial bore of the sleeve independent of the housing enabling rotation of the holder and depth limiter to position the legs of a staple, when in the slot, to straddle the cable without rotating the housing.

* * * * *